United States Patent [19]

Haller

[11] 4,096,587

[45] Jun. 20, 1978

[54] MIXER FOR RESIN AND SAND

[75] Inventor: Walter Haller, Schlieren, Switzerland

[73] Assignee: Escher Wyss Limited, Zurich, Switzerland

[21] Appl. No.: 780,117

[22] Filed: Mar. 22, 1977

[30] Foreign Application Priority Data

Mar. 25, 1976 Switzerland ..... 03722/76

[51] Int. Cl.[2] ..... B01F 5/22; B01F 5/26

[52] U.S. Cl. ..... 366/178

[58] Field of Search ..... 259/DIG. 30, 7, 8, 23, 259/43, 44, 66, 67, 161, 164, 165, 168, 178 A

[56] References Cited

U.S. PATENT DOCUMENTS

| | | | |
|---|---|---|---|
| 2,639,901 | 5/1953 | Teale | 259/8 |
| 2,641,453 | 6/1953 | Teale | 259/DIG. 30 |
| 3,457,047 | 7/1969 | Tokimatsu et al. | 259/24 X |
| 3,717,086 | 2/1973 | Hough | 259/8 X |
| 3,773,299 | 11/1973 | Rebish | 259/161 X |
| 3,929,320 | 12/1975 | Haller | 259/165 |

*Primary Examiner*—Philip R. Coe
*Attorney, Agent, or Firm*—Robert A. Ostmann

[57] ABSTRACT

Mixer for resin and sand comprises walls which form an inlet for the sand, an annular gap for the sand following the inlet, following which gap is an axially symmetrical mixing chamber and an outlet for the mixture; a supply arrangement with pipes for the separate components of the resin is provided in the mixing chamber, and a rotatable dished member is arranged beneath the pipes; two solids of revolution arranged coaxially one above the other are provided between the mixing chamber and the outlet, between which solids an annular intermediate interstice is left for the mixture, the lower of the solids of revolution limiting the mixing chamber in the downward axial direction and being rotatable; the dished member of the supply arrangement and arranged below the pipes for the components is connected to the lower, rotatable solid of revolution; that surface of the dished member facing the mixing chamber is made at least partially to rise radially outwards, and, spaced from the rising surface of the dished member, an annular disc which is coaxial therewith and which has a central opening is fixed to the dished member so that an interstice which is open in an outward radial direction is formed between the annular disc and the dished member; at least one component of the resin is guided through the central opening of the annular disc directly to the rising surface of the dished member.

10 Claims, 9 Drawing Figures

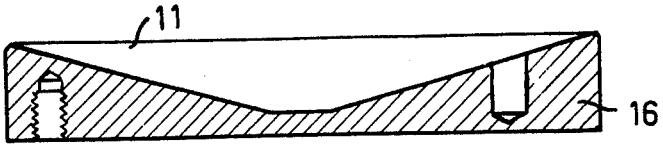
Fig.3
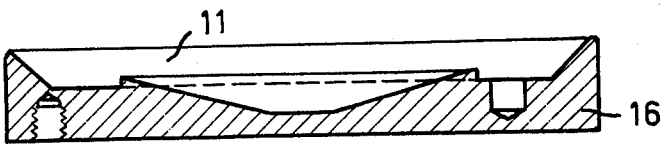
Fig.4
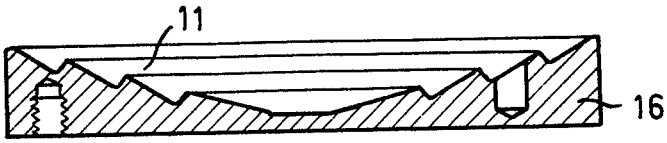
Fig.5
Fig.6
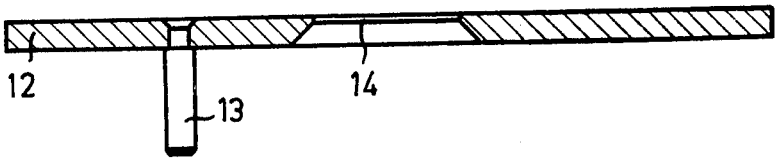
Fig.7
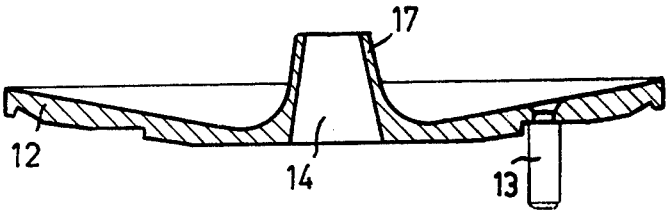
Fig.8
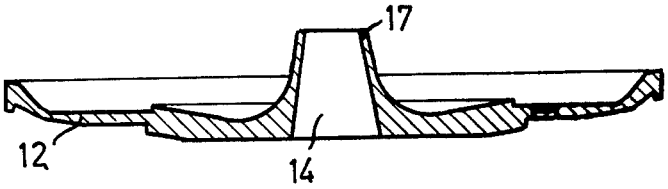
Fig.9
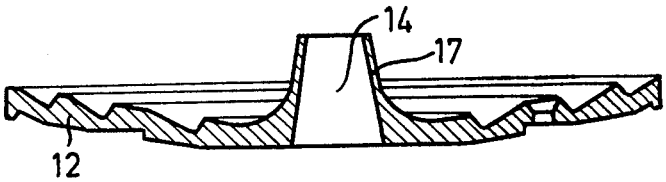

MIXER FOR RESIN AND SAND

BACKGROUND OF THE INVENTION

The invention relates to a resin-sand mixer for preparing a mixture of sand and resin. A known mixer comprises walls which form an inlet for the sand, an annular gap for the sand following the inlet. The gap is followed by an axially symmetrical mixing chamber and an outlet for the mixture. The mixing chamber has provided therein a supply arrangement with pipes for the separate components of the resin and has a rotatable dished member arranged beneath the pipes. Two solids of revolution arranged coaxially one above the other are provided between the mixing chamber and the outlet, between which solids is left an annular interstice for the mixture. The lower of the solids of revolution defines the mixing chamber in a downward axial direction and is rotatable.

Mixers of this type are used in foundries for the preparation of the resin moulding sand. With the prior mixers, the components of the resin are distributed in the sand by spraying. Compressed air serves, for example, for this purpose in one known mixer, by means of which air the components of the resin are atomised and thus dispersed in the sand.

With another known mixer, the components of the resin are guided into a bowl-like rotor device which can be rotated at very high speed by means of an additional motor, the resin being sprayed out of the said bowl by means of centrifugal force through radial openings which are provided.

In both cases, the components of the resin are atomised, as a result of which is a certain danger of explosion of the air-mist mixture as thus formed, due to self-ignition.

SUMMARY OF THE INVENTION

It is one object of the invention to eliminate this danger of explosion in connection with a resin-sand mixer of the type as initially described.

The object is achieved according to the invention by the fact that the dished member of the supply arrangement, arranged beneath the pipes for the components, is connected to the lower, rotatable solid of revolution. That surface of the dished member which is facing the mixing chamber is made so that it rises at least partially in a radial and outward direction, and, at a distance from the rising surface of the dished member, an annular disc which is coaxial with it and has a central opening is fixed to the dished member. An interstice which is open in a radial outward direction is formed between the annular disc and the dished member. At least one component of the resin is guided through the central opening of the annular disc directly on to the rising surface of the dished member which is rotatable together with the lower, rotatable, solid of revolution.

In accordance with another constructional form, the two components of the resin are guided directly on to the dished member which is connected to the lower, rotatable solid of revolution. One of the components, or both components, are split up by the rising surface of the dished member and the components are mixed with one another and projected into the sand in the mixing chamber. However, since the solid of revolution with the dished member revolves relatively slowly, up to 1500 rpm, the result is a substantially coarser distribution of the components of the resin, as a result of which the danger of explosion due to spontaneous ignition of the resin is eliminated. It has been recognised that this coarser division of the resin is fully adequate for producing a resin-sand mixture capable of use. A previous prejudice has been ignored, which is that the resin, at the time of mixing into the sand, had to be sprayed in atomised form.

Because that surface of the dished member which is facing the mixing chamber is made so that it rises radially outwards, at least partially, also viscous components of a resin can be sufficiently distributed along this irregular surface.

An important secondary effect has also been produced in accordance with the invention: any additional energy source, such as compressed air or motor, for dispersing the resin into the sand, such as was used with the prior mixers, becomes superfluous. According to the invention, there is only utilised an energy which is already present, namely, the centrifugal force, which is caused by the already rotating solid of revolution into which the dished member is fitted.

BRIEF DESCRIPTION OF THE DRAWING

The subject of the invention is more fully described and explained hereinafter by reference to the drawings showing constructional examples.

FIGS. 3, 4 and 5 are constructional examples in vertical section and to a larger scale of the dished member which can be fitted into the solid of revolution, and FIGS. 6, 7, 8 and 9 are vertical sections to a larger scale of the annular disc.

DESCRIPTION OF THE PREFERRED EMBODIMENTS

Figure 1:
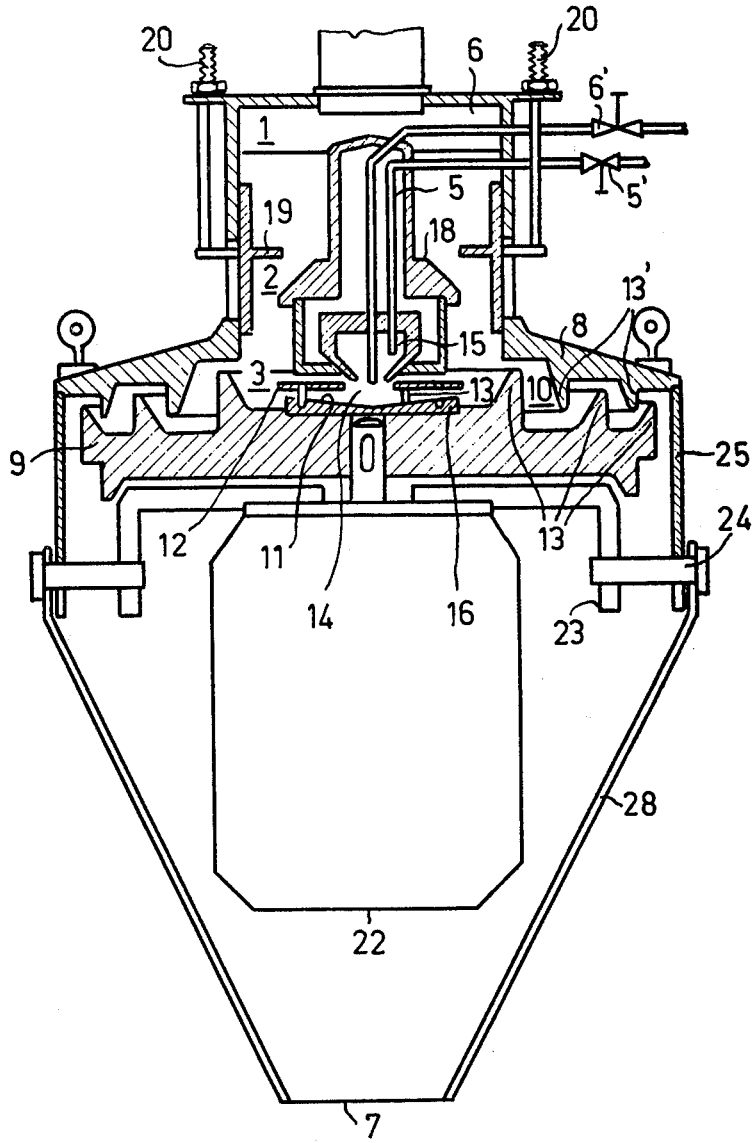
FIG. 1 is a first constructional example in vertical section.

The walls of the resin-sand mixer form an inlet for the sand 1 and, following this inlet, an annular gap 2, through which the sand flows into an axially symmetrical mixing chamber 3. The flow of the sand on the wall 18 is regulated by means of a valve device 19, 20. A rotatably arranged solid of revolution 9 limits the mixing chamber 3 in a downward axial direction and forms an annular intermediate chamber or interstice 10 for the mixture in conjunction with a solid of revolution 8 which is disposed above it and arranged coaxially with it, which mixture is here thoroughly mixed on account of projections 13 and 13' which are provided and leaves the resin-sand mixer along the walls 25 and 28 through the outlet 7. The rotatable solid of revolution 9 is driven by a motor 22, which is suspended and supported by means of parts 23 and 24 on the wall 25.

The components of the resin and respectively a hardening agent and a binder are fed into the mixer by means of a supply arrangement. Serving for this purpose are pipes 5 and 6, the flow of the components being adjusted by means of valves 5' and 6', respectively.

Beneath the pipes 5 and 6, a dished member 16 is connected to the lower, rotatable solid of revolution 9 and coaxially with it. Consequently, it rotates with the rotating solid of revolution 9. Arranged at a distance from the dished member 16 and coaxially with it is an annular disc 12, which is fixed to the dished member 16 by means of pins 13 and as a consequence is rotatable with the rotating dished member 16 and with the solid of revolution 9. The annular disc 12 has a central opening 14, through which the pipe 6 for one component of the resin is directed towards the rising surface 11 of the dished member 16 on the body 9, so that one of the components is able to flow on to the surface 11. With this constructional example, as shown in FIG. 1, the second component of the resin which is supplied through a pipe 5 via the central opening 14 in the annular disc 12 is guided on to the rising surface 11 of the dished member 16.

Provided centrally in the mixer are walls which form a funnel-shaped chamber 15 which is arranged coaxially with the axis of the mixer and tapers towards the central opening 14 of the annular disc 12. The pipes 5 and 6 for the separate components of the resin lead into the funnel-shaped chamber 15, which has an opening facing only the central opening 14 of the annular disc 12. The pipe 6 is guided centrally and coaxially through the chamber 15 and is directed through the central opening 14 of the annular disc 12 towards the rising surface 11 of the dished member 16. The pipe 5 for the other component of the resin is guided laterally into the funnel-shaped chamber 15 and opens on to the sloping wall of the funnel-shaped chamber 15. The second component of the resin accordingly flows along the sloping chamber wall, at the rim of the opening of the funnel-shaped chamber 15 through the central opening 14 of the annular disc 12 on to the rising surface 11 of the dished member 16.

On the dished member 16, by rotation of the surface 11 thereof, with the rotating solid of revolution 9, the components of the resin are mixed together along the rising surface 11 and dispersed, and are projected radially outwards by means of centrifugal force from the space between the rising surface 11 and the annular disc 12 and admixed with the sand in the mixing chamber 3.

The dished member 16 is fixed to the body 9 in a readily releasable manner. This provides the advantage that the contour of the rising surface 11 can be easily changed by fitting different available replacment dished members, so that in this way different types of resin can be admixed with the sand. The at least partially rising surfaces 11 of the replacement dished members are so constructed that allowance is made for the different properties of the components of the various types of resin, particularly as regards their consistency. The rise or slope of the surface is advantageously a broken surface, so that also viscous components can be sufficiently dispersed by the steps on the surface 11. Examples of such formations of the surface 11 are shown by way of illustration, more particularly in FIGS. 3, 4 and 5.

With the constructional form of the resin-sand mixer in accordance with FIG. 1, as just described, it is possible to use a type of resin of which the components show a relatively slow mutual reaction and as a consequence can be already mixed together before they are admixed with the sand in the mixing chamber 3.

However, also so-called quick-hardening types of resins exist, the components of which, because of the rapidity of their mutual reaction, i.e. rapid hardening of the resin, are only mixed individually with the sand, and can be allowed to react with one another. Therefore, such components have to be admixed separately from one another with the sand.

Figure 2:
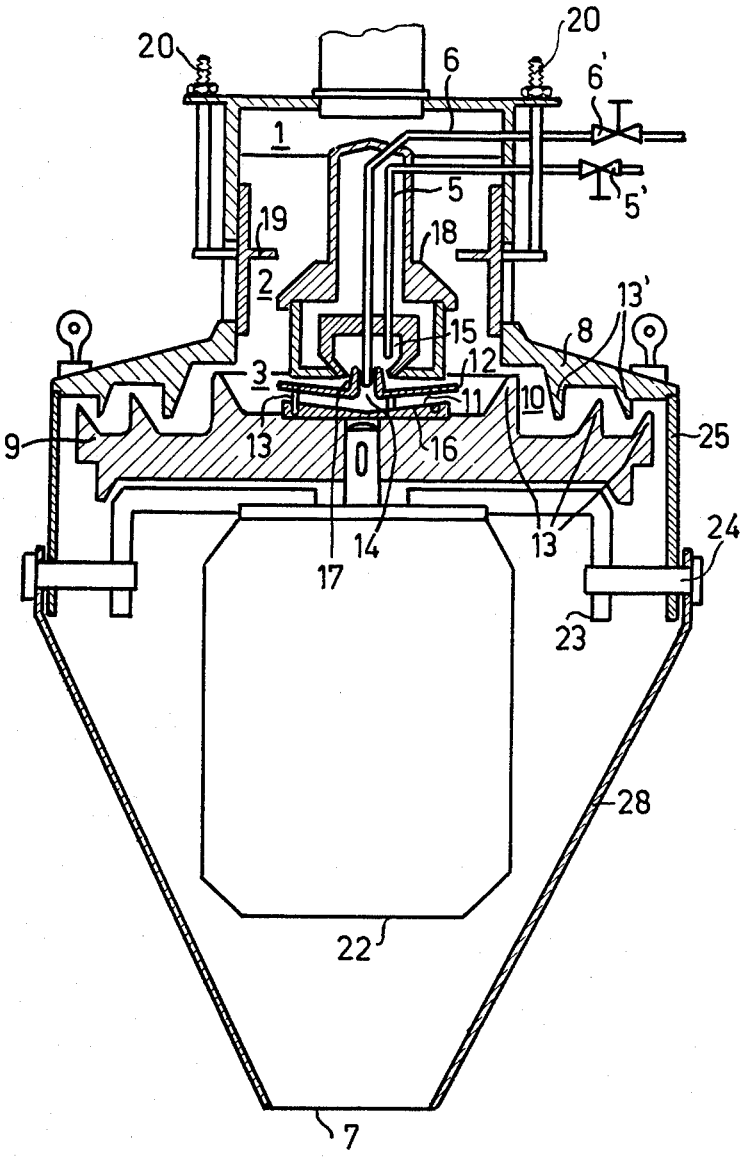
FIG. 2 is another constructional example in vertical section of a resin-sand mixer according to the invention.

Allowance for these circumstances is provided by the constructional form of the resin-sand mixer according to FIG. 2.

In this construction, the annular disc 12 has a neck-piece 17, which is arranged coaxially of the disc, is fixed on the opening 14 and extends through the opening of the funnel-shaped chamber 15. The pipe 6 for one of the resin components is directed through this neck-piece 17 on to the rising surface 11 of the dished member 16, from which the said one component is discharged in dispersed form and admixed with the sand. The other component flows from the pipe 5 on to the sloping wall of the funnel-shaped chamber 15, along the said wall and through a gap provided between the neck-piece 17 of the annular disc 12 and the rim of the opening of the chamber 15 on to that surface of the annular disc 12 which is facing the chamber 15, from which surface it is dispersed, discharged and admixed with the sand by centrifugal force.

In this way, the two components of a quick-hardening resin are admixed separately from one another with the sand in the mixing chamber 3, so that they only start to react with one another in the sand.

Allowing for the different properties of such types of resins, it is possible to use differently profiled replacement annular discs 12, in the same way as with replacement dished members 16. The surface of the replacement annular discs is also made so that it also at least partially rises radially outwards. Examples of such replacement annular discs are shown more particularly by way of FIGS. in FIG. 7, 8 and 9.

The mixer can be easily taken apart, so that access to the rotatable body 9 with the dished member 16 and with the annular disc 12 is relatively simple. After a quick dismantling operation, a replacement dished member or/and replacement annular disc which is/are suitable for the type of resin to be specifically employed is/are fitted into the said body of revolution 9.

By the fitting of such differently profiled dished members 16 or annular discs 12, it is also possible as required to alter the contour of the space between these elements, so that, for example, this space diminishes in a radially outward direction, as shown for example in FIG. 1.

It may also be necessary in certain cases for the funnel-shaped chamber 15 to be aerated, since the dish 16, rotating with the annular disc 12, functions as a radial fan. This is to be effected, for example, by means of an air-supply pipe for the supply of atmospheric air leading into the funnel-shaped chamber 15. Such an air-supply pipe is however not shown in the drawing for the sake of simplicity and because it is familiar to the expert.

By practically eliminating any danger of explosion, it is also possible with advantage, when using the resin-sand mixer according to this invention, to employ a three-phase motor 22 of standard design for driving the solid of revolution 9 with the dish 16 and the annular disc 12, respectively.

I claim:

1. In a foundry mixing machine for preparing a mixture of sand and a resin having at least two components and which comprises wall means defining a sand inlet chamber, a preliminary mixing chamber located below the inlet chamber, and an annular slot positioned vertically between said chambers and serving to allow sand to descend by gravity from the inlet chamber to the preliminary mixing chamber; and an annular final mixing chamber having an inlet at its inner margin which communicates with the preliminary mixing chamber and an outlet at its outer margin, the final mixing chamber being defined by a gap between two axially spaced bodies of revolution, each of which bodies carries projections which extend toward the gap and the lower one of which rotates, the improvement which comprises feeding means for delivering the resin components, in non-atomized states, to sand in the preliminary mixing chamber and which includes a. a dished member connected to rotate with, and located centrally of, the rotatable body of revolution and having an upper surface provided with at least a portion which rises in the radially outward direction;

b. an annular disc coaxial with the dished member and spaced axially therefrom to define an interstice which, at its outer periphery, opens into the preliminary mixing chamber, c. the annular disc having a central opening and being connected to rotate with the dished member and the rotatable body of revolution; and d. supply means for at least one of the resin components which is arranged to deliver said component through the central opening of the annular disc and onto said rising portion of the upper surface of the dished member, e. the dished member serving to coarsely disperse said one resin component and project it radially through said interstice and into sand in the preliminary mixing chamber.

2. A mixing machine as defined in claim 1 in which the feeding means includes second supply means for delivering the second resin component through the central opening of the annular disc and onto said rising portion of the upper surface of the dished member, whereby the resin components are coarsely dispersed and premixed in said interstice and the resulting component mixture is projected radially into sand in the preliminary mixing chamber.

3. A mixing machine as defined in claim 1 in which the feeding means includes second supply means for delivering the second resin component onto the upper surface of the annular disc, whereby the second resin component is coarsely dispersed and projected radially into sand in the preliminary mixing chamber by the annular disc and the two resin components are mixed only after they are comingled with sand.

4. A mixing machine as defined in claim 1 in which a. the feeding means includes wall means defining a funnel-shaped chamber which is located above the annular disc and has a sloping bottom wall which tapers toward a central opening aligned with the central opening of the annular disc, and a supply pipe for the second resin component which is arranged to deliver that component onto said sloping bottom wall; and b. the supply means comprises a separate supply pipe which extends centrally through the funnel-shaped chamber and is arranged to direct the first resin component downward through the central openings in both the sloping bottom wall and the annular disc.

5. A mixing machine as defined in claim 4 in which the sloping bottom wall of the funnel-shaped chamber is arranged to direct the second resin component through the central opening of the annular disc, whereby both resin components are delivered to said rising portion of the upper surface of the dished member.

6. A mixing machine as defined in claim 4 in which the annular disc has a coaxial neck piece which surrounds its central opening and extends upward through the central opening in the sloping bottom wall of the funnel-shaped chamber, the neck piece being spaced radially from the margin of the central opening in the sloping bottom wall to define a gap so that the second resin component may descend from the sloping bottom wall onto the upper surface of the annular disc, whereby the second resin component is coarsely dispersed and projected radially into sand in the preliminary mixing chamber by the annular disc and the two resin components are mixed only after they are comingled with sand.

7. A mixing machine as defined in claim 6 in which the upper surface of the annular disc has at least a portion which rises in the radially outward direction; and the gap between the neck piece and the central opening in the sloping bottom wall overlies the rising portion of the upper surface of the annular disc.

8. A mixing machine as defined in claim 1 in which the axial width of the interstice between the dished member and the annular disc diminishes in the radially outward direction.

9. A mixing machine as defined in claim 1 in which the annular disc is connected with the dished member by pins.

10. A mixing machine as defined in claim 1 in which the annular disc and the dished member are attached to the rotatable body of revolution by easily detachable connectors.

* * * * *